United States Patent [19]

Schmoll, III

[11] 4,127,048

[45] Nov. 28, 1978

[54] PEDAL TONE GENERATOR HAVING MEANS FOR AUTOMATICALLY PRODUCING TONE PATTERNS BASED ON TONIC NOTE

[75] Inventor: George F. Schmoll, III, Dolton, Ill.

[73] Assignee: CBS Inc., New York, N.Y.

[21] Appl. No.: 798,198

[22] Filed: May 18, 1977

[51] Int. Cl.[2] ..... G10F 1/02

[52] U.S. Cl. ..... 84/1.03; 84/1.17; 84/1.24

[58] Field of Search ..... 84/1.17, 1.24, 1.01, 84/1.03

[56] References Cited

U.S. PATENT DOCUMENTS

| | | | |
|---|---|---|---|
| 3,706,837 | 12/1972 | Arsem | 84/1.17 |
| 3,842,702 | 10/1974 | Tsunoo | 84/1.01 |
| 4,020,728 | 5/1977 | Robinson | 84/1.03 |

*Primary Examiner*—Robert K. Schaefer
*Assistant Examiner*—Leonard W. Pojunas, Jr.
*Attorney, Agent, or Firm*—Spencer E. Olson

[57] ABSTRACT

A pedal tone generator for an electronic musical instrument, such as an electronic organ, having the capability of automatically producing bass rhythm patterns based on a tonic note, includes a memory for storing a plurality of rhythm patterns which has a plurality of outputs for producing a predetermined pattern sequence for each of the notes of the diatonic musical scale, and a circuit for producing signals indicative of which of the pedal keys, usually thirteen, is operated by the instrumentalist. The pedal key signals are binary encoded to produce a plurality of code words each unique to the tone of one of the keys, and each of the outputs from the memory is also binary encoded to be uniquely represented by one of a corresponding number of code words. Code words representing a depressed key and the note instantaneouly being "played" by the memory are added to produce a coded digital signal representative of the sum in the duodecimal system of counting. For as long as a pedal key is depressed, the selected pattern from the memory causes the variable modulo counter to produce a pattern of musical tones, each being different from but related to the others, the memory determining the pattern played and the depressed pedal key determining the note at which the pattern sequence starts.

6 Claims, 2 Drawing Figures

PEDAL TONE GENERATOR HAVING MEANS FOR AUTOMATICALLY PRODUCING TONE PATTERNS BASED ON TONIC NOTE

BACKGROUND OF THE INVENTION

This invention relates generally to the electronic production of musical tones and, more specifically, to a system for producing musical patterns of bass tones having a tonic note selected by an instrumentalist.

In the area of automatically controlled musical instruments devices are known which automatically yield musical patterns that may be selected at will by an operator or instrumentalist. One category of such device is the rhythm accompaniment device, which is adapted to produce various rhythms (e.g., fox trot, samba, waltz, etc.) by utilization of various percussion instrument sounds (e.g., drums, follow etc.), the particular rhythm to be played being selectable by the operator or instrumentalist. By utilization of a rhythm accompaniment device in connection with the play of a basic instrument, such as an electronic organ, an instrumentalist can play the melody and the device will provide a rhythm accompaniment, so that the end effect is that of a full band. Rhythm accompaniment devices play on their own, essentially independent of what the instrumentalist is doing. Normally the instrumentalist will condition his beat to coincide with that of the rhythm accompaniment device, but some such devices can be modified to following the beat of the instrumentalist; however, even in the latter case, the only change in the musical output of the device is the beat or speed of the music — there is no change in the basic sound of the music.

A primary problem in providing accompaniment notes or tones is that when a musical note or tone is produced there is a much greater interaction with the music being played by the instrumentalist than when a rhythm accompaniment is being produced. In the latter case, it is only necessary to match the beat of the instrumentalist and the rhythm accompaniment, whereas in the former it is necessary that the played notes or tones produce the proper musical effect when combined with the notes being played by the instrumentalist. As a result, it is necessary that the instrumentalist have control over the tonal nature of the accompaniment being produced.

One known system for providing tonal accompaniment arrangements is that described in Wangard U.S. Pat. No. 3,688,009, and automatically produces a pattern of notes in response to choice of the basic or tonic note by the instrumentalist. The system includes a generator capable of generating a plurality of different predetermined tone sequence patterns, the desired pattern (appropriate to the selection to be played by the instrumentalist and/or the accompanying major rhythm accompaniment) being selected by a push button on the organ console. For each of the patterns, the rhythm generator produces a pattern of driving signals, each of which represents a note in a group of musical notes, which are applied to a tone generator along with reference signals having distinctive voltage magnitudes representative of respective tonic notes having a predetermined interval relationship, and control the generator of the tone pattern in accordance with the driving signals. Selection of the reference signals to be applied to the tone generator is accomplished by operation of the pedal keys of the organ; when a pedal key is played, instead of the single note normally associated with that pedal being played, the selected pattern is generated, the first, or basic note of which corresponds to the pedal depressed, followed by a related group of notes having predetermined interval relationships. As long as that particular pedal is depressed, the pattern automatically repeates itself at a rate determined by a suitable clock, which usually is the same synchronizing clock utilized in the major rhythm unit of the organ, so as to achieve timing between the major rhythm unit and the bass accompaniment device. If, now, a different pedal key is played, a pattern of notes having the same interval relationship is generated, with corresponding notes of the group spaced by the difference in frequency between the tonic notes associated with the two pedals; thus, the instrumentalist can, by playing different ones of the pedal keys, shift the nominal frequency of the preselected pattern "up and down the scale" to provide an added dimension to the playing of music; the effect is known in the trade as "walking bass" and has long been used with commercial success.

While the functional performance of the above-described "walking bass" feature has been satisfactory and well received, it is relatively expensive to manufacture and occupies more space within the organ console than would be desired. A primary reason for this is that the feature was designed as an add-on to a previously available pedal tone generating system with the consequence that some of the circuitry of the pedal tone generator had to be duplicated in the system for producing bass tone patterns; that is, the pedal tone generator and bass tone generating system were not efficiently integrated, resulting in unnecessarily high manufacturing costs to achieve the desired function and also in the requirement that the instrumentalist had to actuate a number of control buttons on the organ console in order to establish a desired pattern.

It is a primary object of the present invention to provide a pedal generator for an electronic organ that will automatically produce a desired pattern of musical tones based upon a tonic note selected by an instrumentalist that is of simpler design, and less costly to manufacture, than systems heretofore available.

Yet another object of this invention is to provide a compact and relatively inexpensive pedal tone generator also having the capability of producing patterns of bass tones having a tonic note selected by an instrumentalist.

SUMMARY OF THE INVENTION

Briefly, the present invention obviates the disadvantages of prior art systems for providing tonal accompaniment arrangements by providing a system utilizing digital techniques and integrated circuit components capable of generating pedal tones in one mode of operation, and in another mode automatically to produce a pattern of notes in response to choice of the basic or tonic note by the instrumentalist. Briefly, the system includes a first encoder for producing a binary word designating which of the usual thirteen pedal key switches is depressed, a rhythm logic device or pattern generator for providing a predetermined pattern sequence of pulses on a plurality of output terminals, one for each of the notes of a musical scale, and a second binary encoder connected to receive and convert the pulses from the rhythm logic to a binary word. The binary word from the first binary encoder, representative of the played pedal key, is combined in a binary adder with the binary word from the second encoder, representative of the note being "played" by the pattern generator, the binary adder being arranged to calculate therefrom in the duodecimal system of coupling, a four-bit digital word representative of what the output tone should be for the played pedal key and the note being "played" by the pattern generator. This four-bit word is decoded in a 4-to-13 line decoder which is operative to produce a single unique output signal which in turn, is utilized to select the dividing factor of a variable modulo counter which divides a predetermined clock frequency by a divisor determined by the unique signal to produce a note having a pitch determined by the described combination of the encoded pedal and pattern generator signals. The thus-generated tone signals are applied through a gating circuit to an audio circuit including a loudspeaker for reproducing the musical tones.

The system is implemented entirely with commercially available integrated circuits, and thus has the advantages of very compact packaging, ease of assembly, and relatively low cost. It is easier to tune than previously available systems in that when the frequencies of the pedal notes are properly tuned, the notes of the bass tone patterns are automatically in tune. The system provides the further advantage that the resulting organ voices are stop-controlled for both the pedal tones and the tone patterns, in contradistinction to the prior art "walking bass" system in which the notes of the bass patterns are generated by separate oscillators, one for each note, over which the system had no control other than to turn them on and off.

Other objects, features and advantages of the invention will become apparent, and its construction and operation better understood, from the following detailed description of a preferred embodiment, taken in conjunction with the accompanying drawings.

DESCRIPTION OF THE PREFERRED EMBODIMENT

Figure 1:
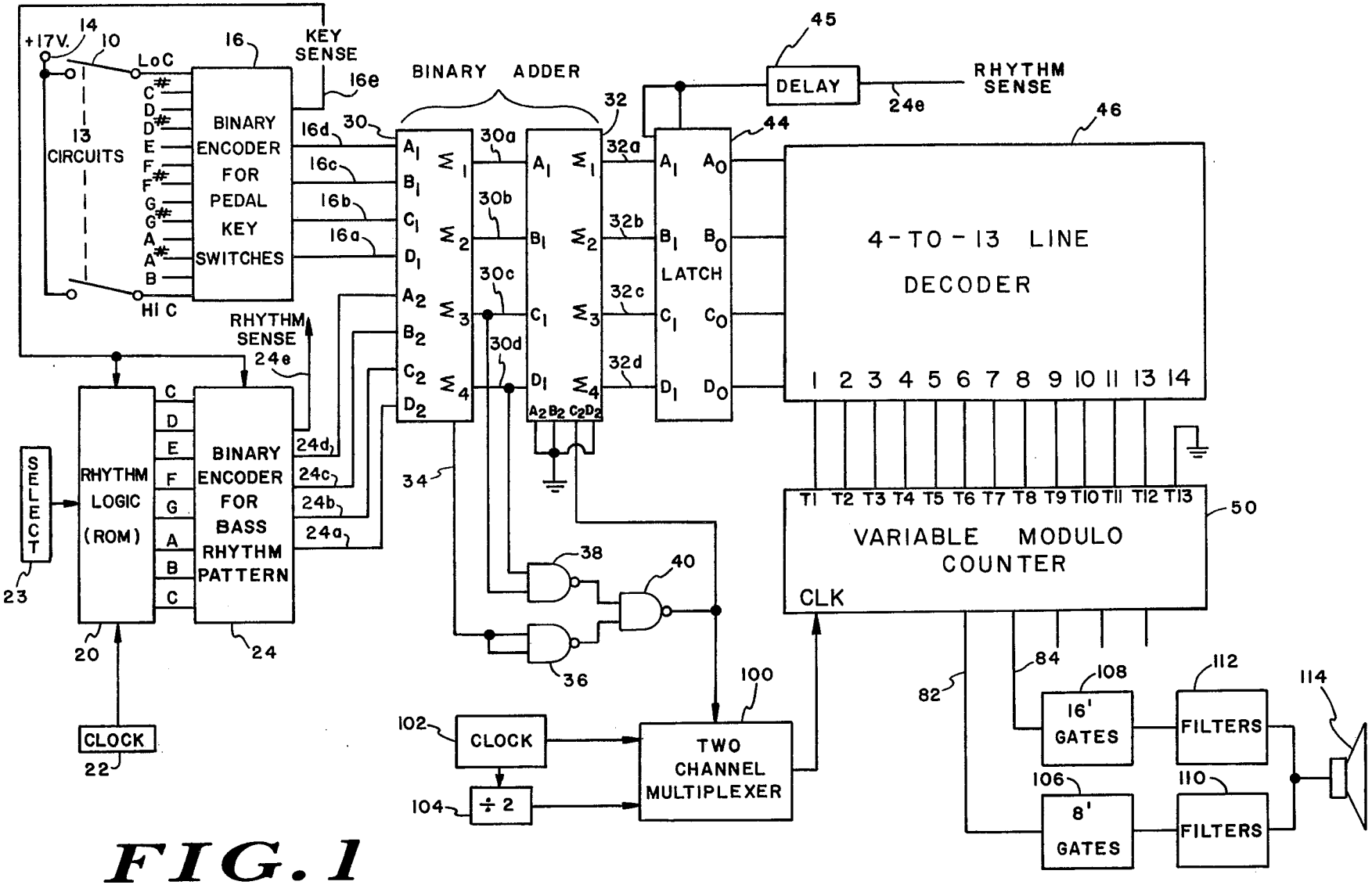
FIG. 1 is a schematic circuit diagram of a pedal generator system according to the invention.

Referring to FIG. 1, the pedal generator system of the invention is actuated by the pedal keyboard of an electronic organ, conventionally having thirteen pedals which, when depressed, close a respective pedal key switch, two of which are shown at 10 and 12. Typically, the pedals encompass a range of one octave of notes, from low C to high C as indicated. When one of the pedals is depressed (and normally only one is depressed at a time) the corresponding key switch applies a DC potential from a source represented by a terminal 14 to a corresponding input terminal of a binary encoder 16. For example, if key switch 10 is closed, a DC potential, typically having a value of 17 volts, is applied to the input terminal of the encoder corresponding to low C and to that terminal only. The encoder 16, preferably implemented with integrated circuit components, may take a variety of forms known to ones skilled in the art and is operative to produce at four output terminals 16*a*, 16*b*, 16*c* and 16*d* a 4-bit binary word that uniquely represents the depressed key. In the present embodiment, the 4-bit word designations of the pedal keys are as set forth in the following table.

TABLE I

| Key | Binary Code |
|---|---|
| Low C | 0000 |
| C# | 0001 |
| D | 0010 |
| D# | 0011 |
| E | 0100 |
| F | 0101 |
| F# | 0110 |
| G | 0111 |
| G# | 1000 |
| A | 1001 |
| A# | 1010 |
| B | 1011 |
| High C | 1100 |

The bass rhythm patterns are provided by a rhythm logic circuit 20, which may, for example, take the form of a known read only memory (ROM), in which a plurality of different rhythm patterns are stored. The rhythm logic 20 generates a pulse train the frequency of which is a multiple of the frequency of a clock 22, which is variable over a range which corresponds to the range over which the rhythm tempo varies for various types of musical compositions. The logic has eight output lines, one for delivering a predetermined combination of pulses for each of the notes C, D, E, F, G, A, B and C of the diatonic scale. The rhythm logic 20 has a memory capacity for storing a plurality of different predetermined tone sequence patterns, which may be characterized as "boogie", "shuffle", "ballad", "rock" and "Latin", and the desired pattern is selected by a push button on the organ console, schematically represented by the block 23. For each of patterns, the rhythm logic produces a pattern of driving signals on its output lines, each of which represents a note in the diatonic scale of musical notes.

Reverting briefly to the encoder 16, it also delivers a "key sense" pulse at a fifth output terminal 16*f* whenever a pedal is depressed; this pulse is applied to and enables a second binary encoder 24 (to be described), and also may be used as an external trigger to the rhythm logic 20 to provide a down-beat whenever a pedal is depressed. The latter may be used by the instrumentalist to create a bass pattern of his own design; for example, he may depress the C pedal momentarily, and the pattern present in the rhythm logic 20 at the time of the down-beat will be added to the pedal tone to produce an output determined by the addition. Then he may momentarily depress a different pedal, for example the G pedal, and the process is repeated. If, however, the instrumentalist wishes to employ the rhythm logic, he keeps the pedal he has selected depressed for at least the duration of the pattern, or for such longer period as desired for the particular selection being played.

The pulse sequences on the eight output lines of the rhythm logic 20 are applied to respective input terminals of a second binary encoder 24 which is operative to encode in 4-bit binary notation the note "played" by the ROM. The encoder 24 is implemented with commercially available integrated circuit chips suitably interconnected in a manner known to ones skilled in the art to produce at its output terminals 24*a*, 24*b*, 24*c* and 24*d* a 4-bit binary word unique to each of the input lines, and a "rhythm sense" pulse at a fifth output terminal 24*e* upon coincidence of a "key sense" pulse from encoder 16 and a pulse of a pulse train on one of the output lines of the rhythm logic 20. It is also to be noted that this condition of coincidence must exist in order for encoder 24 to produce a coded binary output. The "rhythm sense" pulse is used to enable the output gates of the system, the operation of which will be described later. So as to perform correctly with the encoded signals produced at the output of encoder 16 to accomplish the purposes of the invention, the encoder 24 encodes the inputs thereto as set forth in the following table.

TABLE II

| ROM | Binary Code |
|---|---|
| Low C | 0000 |
| D | 0010 |
| E | 0100 |
| F | 0101 |
| G | 0111 |
| A | 1001 |
| B | 1011 |
| High C | 1100 |

It will be noted that the binary code words for the notes of the diatonic scale applied to encoder 24 are the same as the binary words representing the corresponding pedal key switches.

The 4-bit binary words produced by encoders 16 and 24 are applied to a binary adder, which in this embodiment comprises two integrated circuit chips 30 and 32, both of which are Type 7483 produced by National Semiconductor, Texas Instruments and others, and connected as shown. The output terminals 16*a*, 16*b*, 16*c* and 16*d* of encoder 16 are applied to a first sub-set of four input terminals designated $D_1$, $C_1$, $B_1$ and $A_1$, respectively, of the first chip 30, and the output terminals 24*a*, 24*b*, 24*c* and 24*d* of encoder 24 are connected to a second sub-set of four input terminals, designated $D_2$, $C_2$, $B_2$, and $A_2$, respectively, the circuit being operative to produce a 4-bit word output on its four output lines 30*a*, 30*b*, 30*c* and 30*d*. More specifically, the integrated circuit 30 is operative to produce binary sum signals $\Sigma_1$, $\Sigma_2$, $\Sigma_3$ and $\Sigma_4$ according to the following nomenclature:

$$A_1 + A_2 = \Sigma_1$$

$$B_1 + B_2 = \Sigma_2$$

$$C_1 + C_2 = \Sigma_3$$

$$D_1 + D_2 = \Sigma_4$$

The summation $\Sigma_1$ can include a carry which, if present, is added to $\Sigma_2$, which in turn, can include a carry which, if present, is added to $\Sigma_3$, which in turn can also include a carry which, if present, is added to $\Sigma_4$; this summation, too, can include a carry which is brought out (as a logical "1") at a "carry" output pin 34 which is connected to both of the inputs of a NAND gate 36. The output terminals 30*c* and 30*d* are connected to respective inputs of a second NAND gate 38. The output terminals of gates 36 and 38 are connected to respective inputs of a third NAND gate 40, the output terminal of which is connected to the $C_2$ terminal of the second sub-set of input terminals of integrated circuit 32. The input terminals of integrated circuit 32 corresponding to input terminals $A_2$, $B_2$ and $D_2$ of integrated circuit 30 are connected together and to ground potential.

The output terminals 30*a*, 30*b*, 30*c* and 30*d* of integrated circuit 30 are applied to the input terminals $A_1$, $B_1$, $C_1$ and $D_1$, respectively, of integrated circuit 32 which produces sum signals $\Sigma_1$, $\Sigma_2$, $\Sigma_3$ and $\Sigma_4$ in accordance with the nomenclature described above, at its output terminals 32*a*, 32*b*, 32*at output* and 32*d*, respectively. By virtue of the described connection and operation of the adders 30 and 32, when the number represented by the binary output appearing at terminals 30*a*, 30*b*, 30*c* and 30*d* exceeds twelve, as sensed by NAND gates 36, 38 and 40, the binary equivalent of four is added to the number represented by the states of terminals 30*a*, 30*b*, 30*c* and 30*d*, whereby the binary word defined by the states of output terminals 32*a*, 32*b*, 32*c* and 32*d* is now representative of the note to be played, in the duodecimal system of counting that is, a binary word encoded according to the system of counting in which twelve is used as the base. The use of this method of counting is particularly advantageous since there are twelve notes per octave (from C to B), making it relatively simple and straightforward to decode the coded signal produced at terminals 32*a*, 32*b*, 32*c* and 32*d* to derive a given note.

The four output terminals of circuit 32 are connected to respective input terminals $A_1$, $B_1$, $C_1$ and $D_1$ of a latch circuit 44, which may be a Type 4745 integrated circuit manufactured and sold by National Semiconductor, Texas Instruments and others. This latch circuit is provided to compensate for the delay encountered in the binary adder; that is, there is a finite delay between the time that a rhythm sense pulse is produced at output terminal 24*e* of encoder 24 and the time a sum signal having as an addend a binary representation from encoder 24 produced contemporaneously with the rhythm sense pulse appears at output terminals 32*a*, 32*b*, 32*c* and 32*d* of adder 32. The latch circuit receives and temporarily stores the outputs from adder 32 until enabled by an enabling pulse applied thereto; the enable pulse is generated by delaying, in a delay device 45, the rhythm sense pulse by a period slightly longer than the delay encountered in the adders. When the latch 44 is enabled, a 4-bit word corresponding to the binary word applied to the input terminals is produced at four output terminals designated $A_o$, $B_o$, $C_o$ and $D_o$. When the rhythm switch is not operated (i.e., the pedal keyboard is operated in the normal manner), the latch circuit 44 serves no function other than to directly pass the binary information applied to its input terminals.

The 4-bit word at the output of latch circuit 44 (which it will be understood is also according to the duodecimal system of counting) is applied to a 4-to-13 line decoder 46 of known construction, such as an integrated circuit Type 47154 which is a four line-to-sixteen line decoder manufactured by National Semiconductor, Texas Instruments, and others, but utilized in the present application as a 4-to-13 line decoder.

If it is assumed that the binary codes for the pedal keys set forth in Table I above are applied to the input terminals of decoder 46, the logic code words appearing at the thirteen used output pins, each containing thirteen bits, are as set forth in the following Table III.

TABLE III

| | Pins | | | | | | | | | | | | |
|---|---|---|---|---|---|---|---|---|---|---|---|---|---|
| Key | 1 | 2 | 3 | 4 | 5 | 6 | 7 | 8 | 9 | 10 | 11 | 13 | 14 |
| C | 0 | 1 | 1 | 1 | 1 | 1 | 1 | 1 | 1 | 1 | 1 | 1 | 1 |
| C# | 1 | 0 | 1 | 1 | 1 | 1 | 1 | 1 | 1 | 1 | 1 | 1 | 1 |
| D | 1 | 1 | 0 | 1 | 1 | 1 | 1 | 1 | 1 | 1 | 1 | 1 | 1 |
| D# | 1 | 1 | 1 | 0 | 1 | 1 | 1 | 1 | 1 | 1 | 1 | 1 | 1 |
| E | 1 | 1 | 1 | 1 | 0 | 1 | 1 | 1 | 1 | 1 | 1 | 1 | 1 |
| F | 1 | 1 | 1 | 1 | 1 | 0 | 1 | 1 | 1 | 1 | 1 | 1 | 1 |
| F# | 1 | 1 | 1 | 1 | 1 | 1 | 0 | 1 | 1 | 1 | 1 | 1 | 1 |
| G | 1 | 1 | 1 | 1 | 1 | 1 | 1 | 0 | 1 | 1 | 1 | 1 | 1 |
| G# | 1 | 1 | 1 | 1 | 1 | 1 | 1 | 1 | 0 | 1 | 1 | 1 | 1 |
| A | 1 | 1 | 1 | 1 | 1 | 1 | 1 | 1 | 1 | 0 | 1 | 1 | 1 |
| A# | 1 | 1 | 1 | 1 | 1 | 1 | 1 | 1 | 1 | 1 | 0 | 1 | 1 |
| B | 1 | 1 | 1 | 1 | 1 | 1 | 1 | 1 | 1 | 1 | 1 | 0 | 1 |
| C | 0 | 1 | 1 | 1 | 1 | 1 | 1 | 1 | 1 | 1 | 1 | 1 | 1 |

Thus, a single logic code word, uniquely characterized by the position of a logical "0", is produced for each of the pedal keys.

Figure 2:
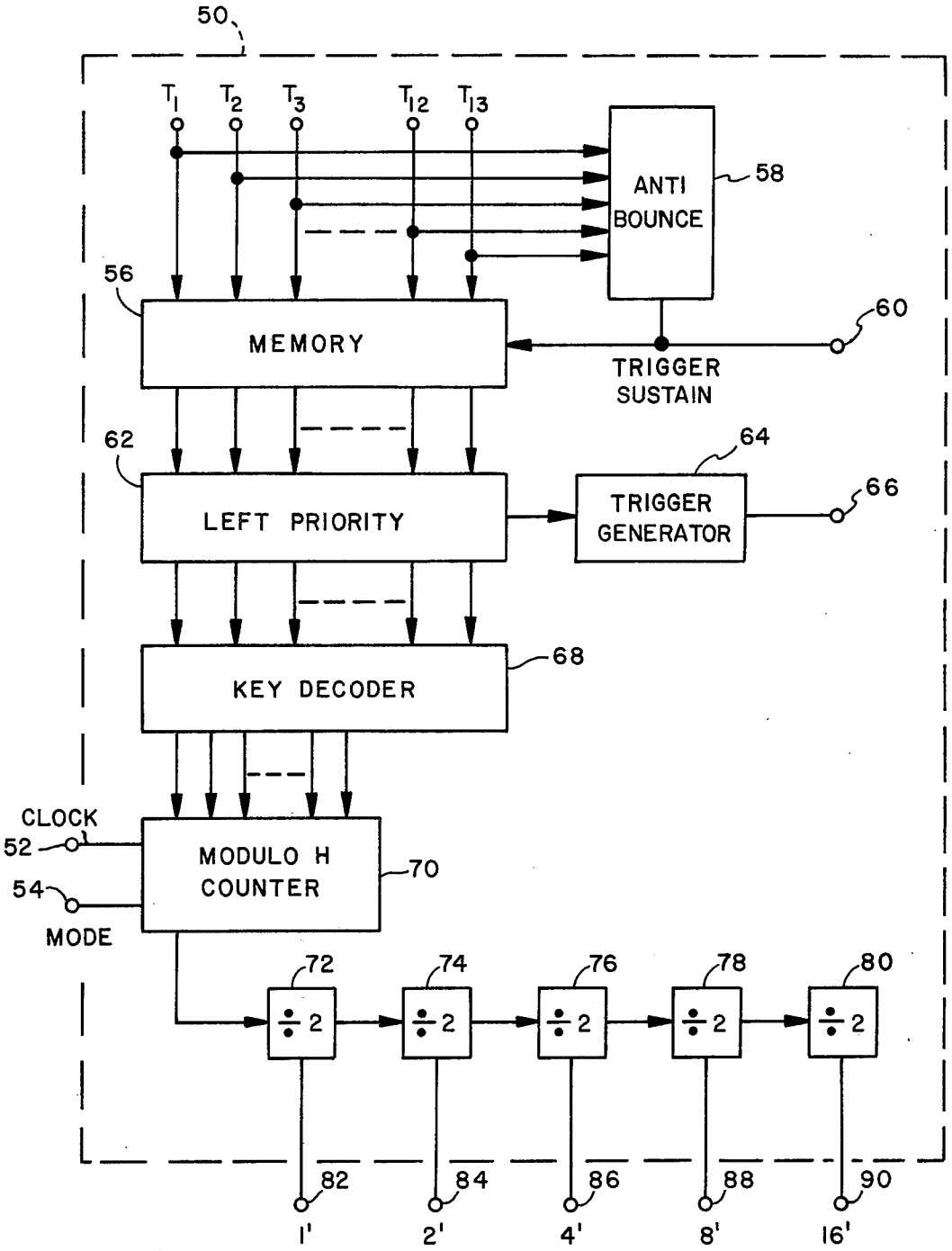
FIG. 2 is a functional block diagram of a portion of the system of FIG. 1.

The output terminals of decoder 46 are connected to respective control terminals of a variable modulo counter 50, which includes a plurality of dividers for dividing the frequency of an applied clock pulse signal by a divisor determined by the unique logic code word applied to the control terminals to produce an output tone signal corresponding to a tone of a musical scale. A particularly useful device for producing the required function is the M147 integrated circuit manufactured in Italy by SGS/ATES, but commercially available in the United States, which the manufacturer calls "13-bit latch pedal sustain". Although designed specifically as a pedal sustain for electronic organs and other musical instruments, the circuit has properties that make it particularly useful in the present system. A functional block diagram of the circuit, which is constructed on a single chip using P-channel silicon gate technology, is illustrated in FIG. 2, and has thirteen input terminals $T_1$ through $T_{13}$ for receiving input control signals, a clock pin 52 to which a clock signal from an external source is applied and an input pin 54 for mode selection. The input terminals are connected to a memory device 56 and also to an anti-bounce system 58, the output of which is applied to the memory and to an output terminal 60 for trigger sustain, the trigger sustain output being activated only when one or more of the inputs are energized; when there is a trigger sustain output, bounces are suppressed by the anti-bounce circuit 58. The integrated circuit also contains a left priority circuit 62, the purpose of which is to ensure that when two or more keys are depressed, only the key furthest to the left (corresponding to the lowest frequency) will be accepted and to activate a trigger generator 64 to produce a trigger percussion pulse at a trigger percussion output terminal 66. A key decoder 68 determines which of the input terminals is energized and drives a modulo H counter 70 which, as has been noted, is driven by an external clock. Associated with counter 70 are five divided-by-two circuits 72, 74, 76, 78 and 80 which divide down the high frequency clock to produce, when an input terminal is energized, a 50% duty cycle square wave signal of the corresponding frequency in five octaves, in parallel, at five output terminals 82, 84, 86, 88 and 90. The circuit is operable in two modes; in a first, the input frequency (clock) must be 500.06 KHz, and in the other mode, the clock frequency must be 2.00024 MHz.

As used in the present system, the "trigger sustain", "left priorty" and "trigger percussion" functions of the M147 integrated circuit are not used, and the mode for which the manufacturer recommends a clock frequency of 500.06 KHz is used. For reasons that will appear later, one or the other of two octavely-related clock frequencies, neither of which is 500.06 KHz but are octavely-related to 500.06 KHz, are applied to the variable module counter; in the present embodiment, a clock freqency of 62.5062 KHz is normally applied, and under certain conditions (to be described) the clock frequency is 125.0125 KHz. Further, of the available five parallel outputs at terminals 82, 84, 86, 88 and 90 of the M147 circuit, only the outputs appearing at terminals 82 and 84, the two highest pitches, are utilized.

Reverting now to FIG. 1, how the system functions to produce normal pedal tones, and bass accompaniment tones, will be apparent from consideration of several operational examples. Considering first the normal operation of the pedal keys, i.e., with the bass rhythm switch "off", and assuming that the depressed pedal key switch is playing the note E, it will be seen from Table I that the binary code 0100 is applied to the first sub-set of input terminal of binary adder 50. Since nothing is being added to this binary number from the rhythm pattern encoder 24, the same binary number appears at the output terminals $A_0$, $B_0$, $C_0$ and $D_0$ of the latch 44, and is applied to the 4-to-13 line decoder 46 which, as will be seen from Table III, decodes this number and produces a unique logic code word having a logic "0" at pin 5 of the decoder; when this word is applied to the control terminals of variable modulo counter 50, the note E in two octaves is produced at output terminal 82 and 84 of the counter.

Assume now that the bass rhythm switch is "on", and that the rhythm logic 20 is presenting a pulse to the line representing the note D, and that the note D is also being played on the pedal. As will be seen from Tables I and II, both of encoders 16 and 24 will in this case apply the binary word 0010 to the binary adder. The output of the adder, that is, the binary sum of the two, is 0100, which from Table I corresponds to the note E, which upon being decoded in the 4-to-13 line decoder 46 produces a logic code word containing a logic "0" on output pin 5 and causes the circuit 50 to produce the note E in two octaves at output terminals 82 and 84.

As another example, let it be assumed that high C is being played on the pedal keyboard and that the rhythm logic is presenting a pulse to the line representing the note G; in this case the binary bits 1100 are applied at inputs $D_1$, $C_1$, $B_1$, and $A_1$, respectively, (the bit applied to terminal $D_1$ is the most significant bit of the binary word) and the binary bits 0111 are applied to terminals $D_2$, $C_2$, $B_2$ and $A_2$, respectively, of the adder stage 30. Employing the nomenclature described earlier, $\Sigma_1 = 1$, $\Sigma_2 = 1$, $\Sigma_3 = 0$, $\Sigma_4 = 0$, and there is a carry "1" at carry pin 34. With a binary "1" at carry pin 34, and also on output terminal 30c of the chip 30, the logic consisting of NAND gates 36, 38 and 40 applies a binary "1" to the $C_2$ input terminal of adder chip 32. When this is added to the bits $\Sigma_1$ through $\Sigma_4$, respectively, of chip 30 applied to the inputs $A_1$, $B_1$, $C_1$ and $D_1$ of the chip 32, the signals at the output terminals of adder chip 32 are: $\Sigma_1 = 1$, $\Sigma_2 = 1$, $\Sigma_3 = 1$ and $\Sigma_4 = 0$. This binary word is decoded by decoder 46 to produce a unique logic code word having a logic "0" on output pin 8 and causes the circuit 50 to divide the clock frequency produce the note G in two octaves at output terminals 82 and 84.

In the just-described example, in addition to being applied to the $C_2$ input of adder chip 32, the positive pulse from NAND gate 40 is applied to a two-channel multiplexer 100 of known construction, which has two inputs, one from a clock oscillator 102 having a frequency of 125.0125 KHz and the other from a divided-by-two circuit 104 connected to divide the frequency of clock oscillator 102 by two; thus, a clock signal having a frequency of 62.5062 KHz is applied as a second input to the multiplexer. The multiplexer is arranged to normally (i.e., in the absence of an enabling pulse from gate 40) apply the lower of the two clock frequencies to the counter 50, and to apply the higher clock frequency when the output of NAND gate 40 is high. Since in this example the higher of the two clock frequencies will have been selected, the output note G will be one octave higher in frequency in each of its two octaves (at terminals 82 and 84) than if the lower of the two clock frequencies had been applied. Specifically, when the multiplexer functions to apply the 125 KHz clock to the counter 50, the output frequencies obtained for the two octaves are as set forth in the following Table IV.

TABLE IV

| Input | Outputs Term. 82 | Term. 84 |
|---|---|---|
| T1 | 130.769 | 65.384 |
| T2 | 138.598 | 69.299 |
| T3 | 146.731 | 73.366 |
| T4 | 155.491 | 77.746 |
| T5 | 164.927 | 82.464 |
| T6 | 174.602 | 87.301 |
| T7 | 184.933 | 92.467 |
| T8 | 195.948 | 97.974 |
| T9 | 207.666 | 103.833 |
| T10 | 220.097 | 110.048 |
| T11 | 233.237 | 116.618 |
| T12 | 247.065 | 123.533 |
| T13 | 261.538 | 130.769 |

In the first-described example (i.e., with the ROM presenting a pulse to the line representing the note D and the note D being played by a pedal) there was no carry from adder chip 30, with the consequence that multiplexer 100 would have selected the 62.5 KHz clock for application to counter 50, thereby to cause the resulting note E to be lower by one octave in each of the two octaves. When the 62.5 KHz clock is applied, the output frequencies for the two outputs are as set forth in Table V.

TABLE V

| Input | Outputs Term. 82 | Term. 84 |
|---|---|---|
| T1 | 65.384 | 32.692 |
| T2 | 69.299 | 34.649 |
| T3 | 73.366 | 36.683 |
| T4 | 77.746 | 38.873 |
| T5 | 82.464 | 41.232 |
| T6 | 87.301 | 43.650 |
| T7 | 92.467 | 46.233 |
| T8 | 97.974 | 48.987 |
| T9 | 103.833 | 51.917 |
| T10 | 110.048 | 55.024 |
| T11 | 116.618 | 58.309 |
| T12 | 123.533 | 61.766 |
| T13 | 130.769 | 65.384 |

Another situation in which a carry pulse is applied to the $C_2$ input of adder chip 32, and also to multiplexer 100 to select the higher clock freqency, is when summations $\Sigma_3$ and $\Sigma_4$ appearing at output terminals 30*c* and 30*d*, respectively, of adder chip 30 are both binary "1"s. When these are applied to the two inputs of NAND gate 38, a positive pulse is produced at the output of NAND gate 40 and applied to the $C_2$ input of adder chip 32 and to multiplexer 100.

The output terminals 82 and 84 of the counter 50 are connected to respective audio gate circuits 106 and 108 of conventional design, such as the gate circuit illustrated in FIG. 2 of U.S. Pat. No. 3,665,090, which couple the respective square wave tone signals produced by the counter to conventional voicing and formant filters 110 and 112, respectively. The outputs of the two filters are combined and applied (after suitable amplification by means not shown) to a transducer such as a loudspeaker 114, for acoustically reproducing the processed tone signals. The audio gates 106 and 108 are controlled by the key sense pulse produced at terminal 16*e* when only the pedals are played, and by the rhythm sense pulse (terminal 24*e* of encoder 24) when the bass rhythm accompaniment is being generated. The filters are stop-controlled from the organ console by the instrumentalist, thereby to provide a control over the bass rhythm notes that is unattainable with the system described in the aforementioned Pat. No. 3,688,009. By using two clock frequencies and a two-channel multiplexer to select the appropriate one for a particular combination of depressed pedal key and ROM note being "played", which is accomplished with relative ease, it is not necessary to alter the audio gate structures when a note generated by the divider 50 appears in the octave above the normal pedal range. That is, in the above-described example where the high C pedal was being held and the pulse from the rhythm logic was present on the line representing the note G, and note G appears in the octave above the normal pedal range; this is accomplished simply by automatically applying the higher clock frequency to the variable modulo counter 50.

The described pedal generator system is adapted to operate in three basic modes. The most straightforward is the normal pedal operation (i.e., without bass rhythm) during which the binary encoder 24 is disabled, and the variable modulo counter 50 produces thirteen notes as the pedal keys are played low C through high C. In a second mode, binary encoder 24 is enabled and accepts pattern determining pulses from the rhythm logic 20, the latter being in a free-running condition. In this mode, the tonic note is selected by the played pedal and it is a matter of chance where in the rhythm pattern the pedal is depressed; however, once the pedal is depressed the pattern will repeat for so long as the pedal is held. In a third mode of operation, the key sense pulse produced by encoder 16 is applied to and enables the rhythm logic (ROM) to start on the downbeat. In this mode, if at the downbeat the rhythm logic provides a pulse at the low C output, whatever pedal is depressed momentarily, that will be the note that will speak; if the low C pedal is depressed, low C will speak, and if the high C pedal is momentarily depressed, high C will speak. If, instead, the ROM provides a pulse at the high C output at the downbeat, then whatever pedal is depressed will cause the note with a pitch an octave higher to speak. Thus, in this mode, the instrumentalist can, by momentarily depressing the pedals, play any bass pattern he wants, the system effectively giving him a twenty-five note capability with only thirteen pedal keys.

Although in the described embodiment one of two automatically selectable clock frequencies is applied to the counter 50, the principle is applicable to situations requiring more than two clock frequencies, for example, three, when it is desired to obtain output tones in three octaves from the counter. It is also to be understood that the described embodiment is merely exemplary of the preferred practice of the present invention and that various changes, modifications, and variations may be made in the details of construction and operation of the elements disclosed herein, without departing from the spirit and scope of the invention.

I claim:

1. Pedal tone generating apparatus for an electronic organ having a first plurality of pedal keys each associated with a different note of a musical scale, said apparatus comprising, in combination:

high frequency generator means for normally producing the lower of at least two octavely-related high frequency pulse signals, a variable divider coupled to said generator means for dividing the frequency of a selected one of the high frequency pulse signals by one of a multiplicity of divisors according to one of a multiplicity of multi-bit logic code words applied to control terminals thereof, said logic code words corresponding to said divisors for producing at two output terminals of said divider octavely-related output tone signals corresponding to tones of a musical scale, first binary encoding means coupled to said pedal keys for producing in response to actuation of a given pedal key a key sense pulse and one of said first plurality of different four-bit digital words uniquely representing the note associated with the actuated key, rhythm logic means having a second plurality of output terminals each associated with a different note of a musical scale for storing at least one rhythm pattern and operative when activated and enabled to produce at each of said output terminals a predetermined pattern of pulses, second binary encoding means coupled to the output terminals of said rhythm logic means for producing when actuated one of said second plurality of different four-bit digital words uniquely representing the musical note associated with the output terminal at which a pattern pulse is present, the digital words representing the different musical notes associated with the output terminals of said rhythm logic means being the same as the digital words that represent corresponding ones of the musical notes associated with said pedal keys, means for applying said key sense pulse to said rhythm logic means and to said second binary encoding means for enabling said rhythm logic means, when activated, and for enabling said second binary encoding means, binary adder means coupled to said first and second binary encoding means for combining the four-bit digital words produced by said first and second binary encoding means and generating at output terminals thereof a four-bit digital word coded in the duodecimal system of counting representative of the pitch of an output tone determined by the four-bit words produced by said first and second binary encoding means, said binary adder means including logic means coupled to said high frequency generator means for causing said generator means to produce pulse signals of a frequency other than said lower frequency whenever the sum of said four-bit words exceeds the equivalent of the number twelve, and decoder means coupled to the output terminals of said adder means and to the control terminals of said variable divider for generating and applying to said variable divider a logic code word corresponding to the four-bit binary word generated by said binary adder means.

2. Pedal tone generating apparatus according to claim 1, wherein said apparatus further comprises first and second gate means coupled to respective ones of the two output terminals of said variable divider for gating the respective output tone signal produced thereat, and first and second filtering means coupled to said first and second gate means, respectively, for individually filtering the output tone signal thereof.

3. Pedal tone generating apparatus according to claim 1, wherein said rhythm logic means is operative to produce a perdetermined pattern of pulses for each of the notes of the diatonic scale.

4. Pedal tone generating apparatus according to claim 1, wherein said binary adder means comprises first and second binary adders each having first and second sub-sets of four each of input terminals and four output terminals, said first adder being operative to produce a four-bit digital word at its output terminals representing the sum of two four-bit digital words applied to respective sub-sets of its input terminals, means for coupling the output terminals of said first adder to the first sub-set of input terminals of said second adder, means for coupling said logic means to selected output terminals of said first adder and to a selected one of the second sub-set of input terminals of said second adder for applying a pulse to said selected one terminal whenever the sum produced by said first adder exceeds the digital equivalent of the number twelve, whereby to produce at the output terminals of said second adder a four-bit word coded in the duodecimal system of counting.

5. Pedal tone generating apparatus for an electronic organ having a first plurality of pedal keys each associated with a different note of a musical scale, said apparatus comprising, in combination:

high frequency generator means for normally producing the lower of at least two octavely-related high frequency pulse signals, a variable divider coupled to said generator means for dividing the frequency of a selected one of the high frequency pulse signals by one of a multiplicity of divisors according to one of a multiplicity of multi-bit logic code words applied to control terminals thereof, said logic code words corresponding to said divisors for producing at two output terminals of said divider octavely-related output tone signals corresponding to tones of a musical scale, binary encoding means coupled to said pedal keys for producing in response to actuation of a given pedal key a key sense pulse and one of said first plurality of different four-bit digital words uniquely representing the note associated with the actuated key, rhythm logic means for producing when actuated one of a second plurality of different four-bit words each uniquely representing a different note of the musical scale, the digital words representing the different notes associated with the rhythm logic means being the same as the digital words that represent corresponding ones of the musical notes associated with the pedal keys, means for applying said key sense pulse to said rhythm logic means for enabling said rhythm logic when actuated, binary adder means coupled to said binary encoding means and said rhythm logic means for combining the four-bit digital words produced by said binary encoding means and said rhythm logic and generating at output terminals thereof a four-bit digital word coded in the duodecimal system of counting representative of the pitch of an output tone determined by the four-bit words produced by said binary encoding means and said rhythm logic means, said binary adder means including logic means coupled to said high frequency generator means for causing said generator means to produce pulse signals of a frequency other than said lower frequency whenever the sum of said four-bit words exceeds the equivalent of the number twelve, and decoder means coupled to the output terminals of said adder means and to the control terminals of said variable divider for generating and applying to said variable divider a logic code word corresponding to the four-bit binary word generated by said binary adder means.

6. Pedal tone generating apparatus according to claim 5 wherein said apparatus further comprises first and second gate means coupled to respective ones of the two output terminals of said variable divider for gating the respective output tone signal produced thereat, and wherein said rhythm logic means is operative to produce a different four-bit word for each of the notes of the diatonic scale.

* * * * *